United States Patent [19]

Otsu et al.

[11] 4,312,585

[45] Jan. 26, 1982

[54] METHOD AND APPARATUS FOR TREATING GRAPHIC ARTS PROCESS PHOTOSENSITIVE MATERIALS

[75] Inventors: Takatoshi Otsu; Yasunobu Tanaka; Osamu Fukushima; Takeshi Mituhashi; Tadatune Mizuno; Toshiko Ogawa; Kazuo Ichikawa, all of Minami-ashigara, Japan

[73] Assignee: Fuji Photo Film Co., Ltd., Minami-ashigara, Japan

[21] Appl. No.: 83,202

[22] Filed: Oct. 10, 1979

[30] Foreign Application Priority Data

Oct. 12, 1978 [JP] Japan ..... 53/125599

[51] Int. Cl.[3] ..... G03D 3/02

[52] U.S. Cl. ..... 354/321; 354/324; 134/122 P

[58] Field of Search ..... 354/316, 319, 320, 321, 354/322, 324; 134/64 P, 122 P

[56] References Cited

U.S. PATENT DOCUMENTS

| | | | |
|---|---|---|---|
| 3,263,345 | 8/1966 | Fleisher et al. | 354/319 |
| 3,311,039 | 3/1967 | Lucas | 134/122 P |
| 3,366,025 | 1/1968 | Layne | 354/324 |
| 3,463,073 | 8/1969 | Knibiehly | 134/122 P |
| 3,532,048 | 10/1970 | Hope et al. | 354/320 |
| 3,595,159 | 7/1971 | Bull | 134/122 P |
| 3,922,702 | 11/1975 | Gaskell | 134/122 P |
| 4,034,389 | 7/1977 | Huss | 354/316 |
| 4,140,384 | 2/1979 | Shintani et al. | 134/122 P |

FOREIGN PATENT DOCUMENTS

| | | | |
|---|---|---|---|
| 2455518 | 5/1976 | Fed. Rep. of Germany | 354/324 |
| 737539 | 9/1955 | United Kingdom | 354/324 |
| 1116842 | 6/1968 | United Kingdom | 354/324 |

*Primary Examiner*—L. T. Hix
*Assistant Examiner*—Alan Mathews
*Attorney, Agent, or Firm*—Sughrue, Mion, Zinn, Macpeak & Seas

[57] ABSTRACT

A method and apparatus for uniformly developing a graphic arts process photosensitive film by producing a uniform laminar flow of treating liquid over the surface of the film as it passes through a treatment bath. The film is conveyed vertically on a rack through the bath with a U-turn near the bottom. Treatment fluid is flowed horizontally below the U-turn. Discharge and withdrawal pipes in the treatment bath container and apertures in the rack positioned at disclosed preferred locations provide the desired flow pattern.

14 Claims, 8 Drawing Figures

METHOD AND APPARATUS FOR TREATING GRAPHIC ARTS PROCESS PHOTOSENSITIVE MATERIALS

BACKGROUND OF THE INVENTION

The invention relates to a method for treating a photosensitive material by conveying the material vertically with a U-turn in a treating bath in which a treating liquid is circulated and an apparatus for practicing the method. The invention also relates particularly to the flow of the treating liquid in the treating bath.

In the case where a photosensitive material is treated by conveying it through a treating bath in which a treating liquid is circulated, it is difficult to finish the photosensitive material with a uniform density and uneven developing results if the treating liquid near the photosensitive material is exhausted. In order to prevent uneven developing, it is necessary to permit the treating liquid to flow continuously. In the treatment of ordinary photographic photosensitive materials or X-ray films, good results can be obtained if the treating liquid is maintained in motion. When it is necessary to add supplemental liquid, uneven developing can be prevented by uniformly mixing the supplemental liquid in the treating liquid in the treating bath.

In treating a graphic arts-type photosensitive material such as a lithographic film in which the picture density is expressed as variations in dot area, the preferred developing method employs infectious development. Accordingly, it is difficult to finish the photosensitive material with a uniform density because of the non-uniform velocity of the treating liquid on the surface of the photosensitive material caused by circulation of the treating liquid and because of eddies formed in the treating liquid. Especially, as the width of the photosensitive material increases, this particular difficulty becomes more prominent.

In order to prevent such uneven developing, a method has been previously employed in the art in which concentration of exhausted treating liquid near a film surface is prevented. In another conventional method for preventing uneven developing, the treating liquid is allowed to flow to the extent that no exhausted treating liquid remains near the film surface and no turbulence is permitted in the flow of treating liquid. In most of these conventional methods, a film is conveyed by means of a rack including plural rollers which are supported between side boards and a treating liquid discharging pipe and a treating liquid withdrawal pipe are provided inside the rack in order to obtain a uniform flow of treating liquid for the surface of the film. Accordingly, it is substantially essential to use such a rack in the conventional method.

One example of a conventional method in which a treating liquid is withdrawn into the inside of a rack so as to provide a uniform liquid flow on the surface of a film is shown in FIG. 1 and FIG. 2. Feeding rollers 1, guides 2, flow regulating boards 3 serving also as guides, and a suction chamber 4 are provided between side boards 5. The suction chamber 4 is provided with a number of liquid withdrawal inlets 6 adapted to withdraw the liquid by suction between the flow regulating boards 3 and a conveyed film P. Circulation of the treating liquid is as shown in FIG. 2. That is, the treating liquid supplied by a circulating pump 7 passes through a filter 8 and enters a temperature control chamber 10 provided at the bottom of a treating bath 9.

The temperature of the liquid in the temperature control chamber 10 is controlled by a temperature control system including a heater 11, a cooling pipe 1 and a thermistor 13. The temperature controlled liquid introduced through a liquid discharging outlet 14 into the treating bath 9. The treating liquid in the treating bath flows between the film P conveyed as shown in FIG. 1 and the flow regulating boards 3 in the rack (not shown in FIG. 2) and circulates by force of the suction pressure provided through withdrawal inlets 6. The treating liquid is supplemented by supplying additional treating liquid to the treating liquid circulating path through a supplementing pipe 15. Excess amounts of treating liquid are discharged by overflow. The discharge of the treating liquid in the system is carried out by operating a discharge valve 16.

An example of a method in which treating liquid is discharged from the inside of a rack to provide a uniform liquid flow on the surface of a film is as shown in FIGS. 3 and 4. That is, feeding rollers 1, guides 2, and a liquid discharging pipe 17 are disposed between side boards 5. The liquid discharging pipe 17 is provided with a number of liquid discharging outlets 18 so as to provide a uniform liquid flow on the surface of a conveyed film. Circulation of the treating liquid is such that the liquid is delivered by a pump (not shown) and subjected to temperature control by a temperature control system after which the liquid thus processed is supplied to the liquid discharging pipe 17 to be discharged through the liquid discharging outlets 18. Furthermore, the treating liquid in a treating bath 9 is circulated through a liquid withdrawal inlets 19.

The apparatus for implementing these conventional methods are intricate in construction and accordingly difficult to manufacture. The method illustrated in FIGS. 1 and 2 in which a number of liquid withdrawal inlets are provided inside the rack is advantageous in that the direction and velocity of the flow of treating liquid are uniform on the surface of the film. However, it is still disadvantageous in that uneven developing is caused because the film is attracted towards the liquid withdrawal inlets 6 thus bringing the film into contact with the guides or the flow regulating boards 3. Furthermore, the method is disadvantageous in the following points. First, if the liquid flow openings 20A of the suction chamber 4 are completely connected to the liquid flowing openings 20B of the liquid treating bath 9, it is then difficult to disconnect the suction chamber 4 from the bath 9 for inspecting and cleaning the rack. If these openings 20A and 20B are not completely connected to one another, then the liquid leaks as a result of which the efficiency of feeding the liquid through the liquid withdrawal inlets 6 decreases. Furthermore, since a number of liquid withdrawal inlets 6 having a small diameter and a number of liquid regulating boards 3 are used, the resistance to the flow of liquid is high and, accordingly, the pump for circulating the treating liquid must be a high head.

The method described with reference to FIGS. 3 and 4 in which a number of liquid discharging outlets 18 are provided inside the rack is also disadvantageous in that the position of the liquid discharging pipe 17 and the diameter and orientation of the liquid discharging outlets 18 must be determined carefully. In addition, the method suffers from the same problems as those suffered by the method using the liquid withdrawal inlets 8 described above. Moreover, the apparatus for practicing these conventional methods are also disadvantageous in that they are intricate in construction and accordingly high in manufacturing cost.

Accordingly, an object of the invention is to provide a method by which a flow of liquid suitable for treating a graphic arts process photosensitive material can be maintained at the surface of the material without employing a conventional intricate method in which the liquid withdrawal or discharging openings are provided inside the rack. It is also an object of the invention to provide an apparatus for practicing this method.

SUMMARY OF THE INVENTION

The foregoing objects and other objects of the invention have been achieved by the provision of a method for treating a graphic arts process photosensitive material by conveying the photosensitive material vertically with a U-turn in a treating bath in which a treating liquid is circulated, in which method, according to the invention, the photosensitive material is conveyed with the photosensitive layer thereof facing outwardly and with the flow of the treating liquid directed along the photosensitive layer surface of the photosensitive material substantially perpendicular to the direction of conveyance of the photosensitive material. There is also provided in accordance with the invention an apparatus for implementing the method, that is an apparatus for treating a graphic arts process photosensitive material by conveying the photosensitive material vertically with a U-turn in a treating bath in which a treating liquid is circulated, in which apparatus, according to the invention, a space is provided between the bottom of the treating bath and a part of the photosensitive material at which the photosensitive material makes the U-turn so that the treating liquid flows therein. A liquid discharging pipe is provided which is adapted to discharge the treating liquid into a liquid pool formed in the space in such a manner that the treating liquid flows from one side wall of the treating bath to the other side wall thereof.

DESCRIPTION OF THE PREFERRED EMBODIMENTS

The invention will be described in detail with reference to FIGS. 5 through 8 which illustrate an example of an apparatus for treating a graphic arts process photosensitive material according to the invention.

Figure 1:
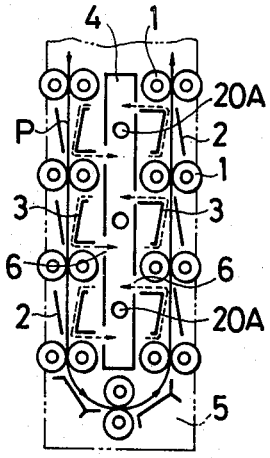
FIG. 1 PRIOR ART
FIG. 1 is a side view showing the essential components of a rack employed in a conventional treating apparatus.
Figure 2:
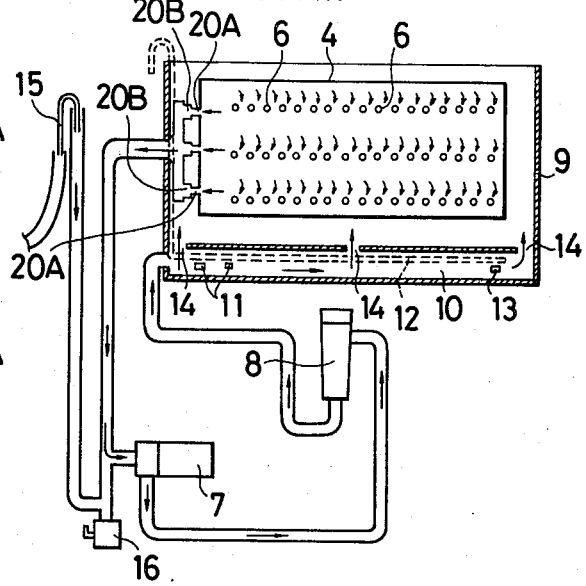
FIG. 2 PRIOR ART
FIG. 2 is a front view showing a section of a liquid suction chamber and a treating bath in the apparatus of FIG. 1 and a circulation system thereof.
Figure 3:
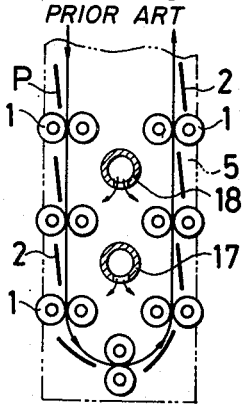
FIG. 3 PRIOR ART
FIG. 3 is a side view showing the essential components of a rack employed in another conventional treating apparatus.
Figure 4:
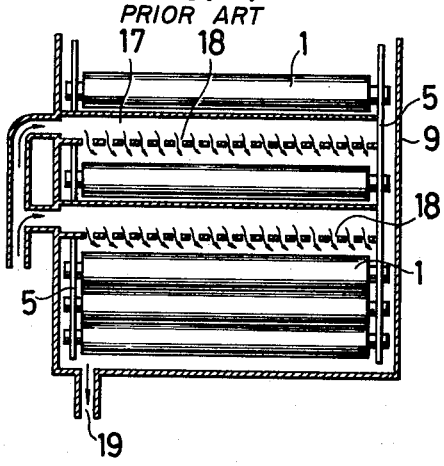
FIG. 4 PRIOR ART
FIG. 4 is a front view showing a section of the rack, a liquid discharging pipe of the rack and a treating bath in the apparatus shown in FIG. 3.
Figure 5:
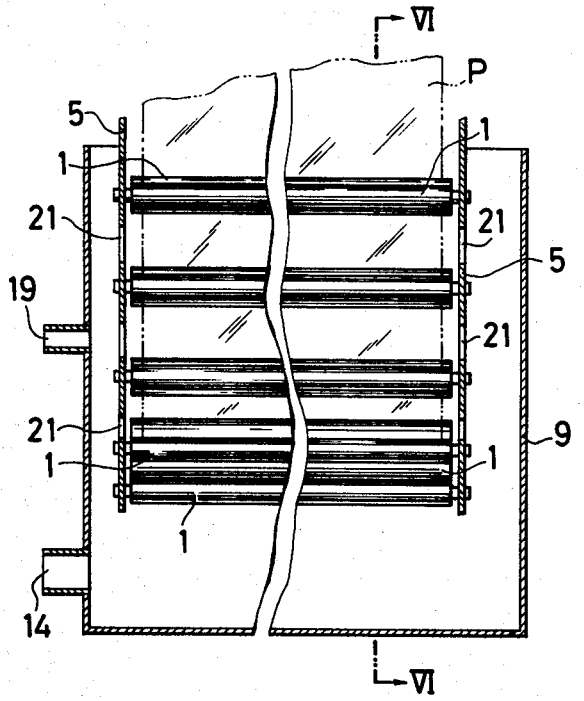
FIG. 5 is a front view showing components of a treating apparatus according to the invention.
Figure 6:
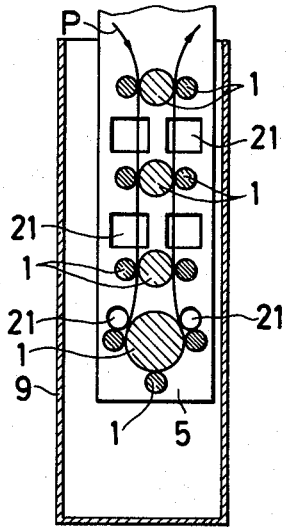
FIG. 6 is a sectional view taken along the line VI—VI in FIG. 5.
Figure 7:
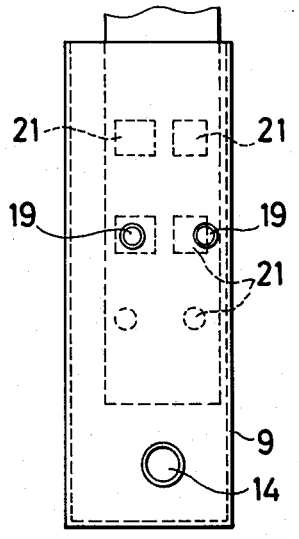
FIG. 7 is a side view of the apparatus shown in FIG. 5.

FIGS. 5 through 7 show the relation between a treating bath and a rack in the apparatus according to the invention. More specifically, FIG. 5 is a front view, partly as a sectional view, of the bath and the rack while FIG. 6 is a sectional view taken along the line VI—VI in FIG. 5 and FIG. 7 is a side view.

In the example shown in these figures, the rack includes feed rollers 1 arranged along three lines. The rollers 1 are rotatably mounted on side boards 5. The shafts of the rollers 1 are connected through gears (not shown) so that they can be rotated by a drive means (not shown). A lithographic film P is inserted between the rollers 1 on the center line and the rollers 1 provided outside them to the left in the view of FIG. 6. The feed roller 1 provided in the U-turn section of the rack is larger in diameter so that the lithographic film P can make a gradual U-turn at that position. Film guides (not shown) are provided between the feed rollers and at the U-turn section. The film guides other than those at the U-turn section are in the form of a comb so that the treating liquid can pass therethrough. The side boards 5 have apertures in the form of through-holes 21 through which the treating liquid can readily pass. The through-holes 21 are positioned outside the film path and the area of each through-hole 21 is made as large as possible so that the treating liquid can readily pass therethrough. Instead of the through-holes 21, slots may be employed. In that case, it is preferable that the slots do not greatly overlap the positions of the rollers.

In a treating bath 9, the rack is sufficiently spaced from the bottom of the treating bath 9 so that the treating liquid can freely flow therein. The treating bath 9 is provided with a liquid discharging pipe 14 adapted to introduce the liquid into a liquid pool in the space formed by the rack and the bottom of the treating bath and a liquid withdrawal pipe 19 adapted to return the treating liquid from the treating bath 9 to a circulating pump.

It is necessary that the space between the rack and the bottom of the treating bath be at least 40 mm, preferably 80 mm, depending on the width of the lithographic film P to be treated. In this example, the space is about 80 mm for treating a film having a width of about 635 mm. Preferably, the flow rate of the treating liquid discharged through the liquid discharging inlet 14 is about 30 cm/sec. With a total quantity of treating liquid in the treating bath of 40 liters, the total flow rate of circulating liquid is of the order of 10 liters/min which is about half of that necessary in the conventional treating method. As for the through-holes 21 of the rack, the positions of the liquid withdrawal pipes 19 are outside the film path. The most suitable positions of the pipes 19 depend on various factors such as the length of the rack and the arrangement of the rollers. However, a preferable result can be obtained by providing one pipe 14 at a height of about 10 to 30% of the total height of the device and another pipe 19 at a height of about 55 to 75% of the total height.

Figure 8:
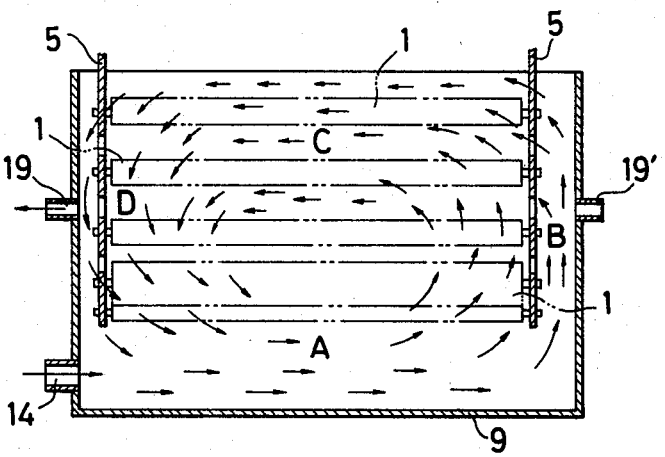
FIG. 8 is a sectional view of the apparatus of FIGS. 5–7 showing the flow of the treating liquid therein.

In the treating bath 9, the treating liquid flows outside the rollers generally as indicated by the arrows in FIG. 8. As a result of this flow of treating liquid in the in the treating bath, a secondary flow of treating liquid in the form of laminar flow is produced on the surface of the film and in the vicinity thereof. This secondary flow makes it possible to provide a uniform development density. The liquid withdrawal pipe 19 may be provided at a position opposite to the position of the liquid discharging inlet as indicated by the chain line 19'. In this case, the general flow of liquid is substantially similar to that described above and substantially the same effect can be obtained.

The general circulation of treating liquid in the treating bath is indicated by the arrows in FIG. 8. That is, the flow A moves from one side wall of the treating bath to the other side wall between the bottom of the treating bath and the photosensitive material which is conveyed while making the U-turn, the flow B moves upwardly along the edge of the photosensitive material which is conveyed vertically, the flow C moves from the other side wall of the treating bath to the one side wall along the surface of the photosensitive material, and the flow D moves downwardly along the edge of the photosensitive material as has been confirmed experimentally. The fact that the secondary flow is in the form of laminar flow on the surface of the photosensitive material and in the vicinity thereof has also been confirmed experimentally. However, the precise reasons why such a phenomena occurs are not understood as yet. This however, in no manner detracts from the usefulness of the invention.

A preferred method of treating a graphic arts process photosensitive material and an apparatus for practicing the method according to the invention have been described above. In accordance with this method and apparatus, the amount of treating liquid circulated by continuous withdrawal and discharge is of the order of half of that required by the conventional method in which the treating liquid is discharged from inside the rack or withdrawn into the inside of the rack.

In the case where a rack is employed in which rollers are arranged in three lines, it is difficult to effectively carry out the discharging and withdrawal of the treating liquid inside the rack. However, this difficulty can be eliminated by employing the method according to the invention.

Furthermore, in the conventional method, if the type rack is changed, then it is necessary to modify or adjust the various components thereof in order to effectively withdraw or discharge the treating liquid. On the other hand, in the present invention, irrespective of the construction of the rack, photosensitive material can be finished with a uniform density and, accordingly, the apparatus can be easily designed and manufactured.

What is claimed is:

1. A method for treating a graphic arts process photosensitive material comprising the steps of: introducing a treating liquid through an inlet in a first vertical side wall of a treating bath, removing said treating liquid through an outlet in said vertical side wall, whereby said treating liquid is circulated in said treating bath, conveying said photosensitive material vertically with a U-turn in said treating bath in which said treating liquid is circulated, said photosensitive material being conveyed with the photosensitive layer facing outwardly, flowing said treating liquid along the photosensitive layer surface of said photosensitive material in a direction substantially perpendicular to the direction of movement of said photosensitive material.

2. A method as claimed in claim 1 wherein said step of flowing said treating liquid comprises:

(a) flowing portions of said treating liquid from said first vertical side wall of said treating bath to an opposite vertical side wall thereof, between a bottom wall of said treating bath and said photosensitive material where said photosensitive material makes said U-turn, (b) flowing portions of said treating liquid upwardly along edges of said photosensitive material conveyed vertically, (c) flowing portions of said treating liquid from said first vertical side wall to said opposite side wall along the surface of said photosensitive material as it is conveyed vertically, and (d) flowing portions of said treating fluid downwardly along the edge of said photosensitive material as it is conveyed vertically.

3. Apparatus for treating a graphic arts process photosensitive material comprising: a container for holding a treating liquid, means for conveying said photosensitive material vertically with a U-turn in said treating bath, a space being provided between the bottom of said treating bath and a position at which photosensitive material makes said U-turn to permit said treating liquid to flow therein, a liquid discharging pipe at a first vertical side wall of said container adapted for discharging said treating liquid into a liquid pool formed in said space, and a liquid withdrawal pipe at said first vertical side wall of said container, said liquid discharging pipe and said liquid withdrawal pipe being vertically displaced from each other such that said treating liquid flows from said first vertical side wall of said treating bath to a second vertical side wall thereof, across said photosensitive material in a direction perpendicular to a direction in which said material is conveyed.

4. The apparatus as claimed in claim 3 wherein said liquid discharge pipe is /positioned at said space.

5. The apparatus as claimed in claim 3 wherein said conveying means comprises a rack comprising a pair of side boards, a plurality of rollers supported on said side boards in which apertures are formed through which said treating liquid can flow, and at least one part of each of said apertures being positioned outside the vertical portion of the passage of said photosensitive material while confronting said vertical portion.

6. The apparatus as claimed in claim 3 wherein said conveying means comprises a rack comprising a pair of side boards, a plurality of rollers supported on said side boards, a plurality of apertures being formed in said side boards in such a manner that said apertures do not greatly overlap the positions of said rollers.

7. The apparatus as claimed in claim 5 wherein said rollers in said rack are arranged in three lines.

8. The apparatus as claimed in claim 6 wherein said rollers in said rack are arranged in three lines.

9. The method of claim 1 wherein said treating liquid is removed from said treating bath at a height of approximately 55–75% of the height of said treating bath.

10. The method of claim 9 wherein said treating liquid is introduced to said treating bath at a height of approximately 10–30% of the height of said treating bath.

11. The apparatus of claim 4 wherein said liquid withdrawal pipe is positioned on said vertical side wall at approximately 55–75% of the height of said container.

12. The apparatus of claim 11 wherein said liquid discharging pipe is positioned on said vertical side wall at approximately 10–30% of the height of said containers.

13. The apparatus of claims 5 or 6 wherein said liquid pool is formed between the bottom of said rack and the bottom of said container.

14. The apparatus of claim 13 wherein the distance between the bottom of said rack and said bottom of said container is at least 40 mm.

* * * * *